US007017456B2

(12) United States Patent
Berman

(10) Patent No.: US 7,017,456 B2
(45) Date of Patent: Mar. 28, 2006

(54) ADJUSTABLE CLOSED-END WRENCH

(76) Inventor: Charles N. Berman, 8028 Providence Court La., Charlotte, NC (US) 28270

( * ) Notice: Subject to any disclaimer, the term of this patent is extended or adjusted under 35 U.S.C. 154(b) by 204 days.

(21) Appl. No.: 10/448,873

(22) Filed: May 30, 2003

(65) Prior Publication Data

US 2004/0237729 A1 Dec. 2, 2004

(51) Int. Cl.
*B25B 23/16* (2006.01)

(52) U.S. Cl. ..... 81/177.8

(58) Field of Classification Search ..... 81/177.7, 81/177.8

See application file for complete search history.

(56) References Cited

U.S. PATENT DOCUMENTS 2,708,855 A * 5/1955 Fish ..... 81/61
4,901,608 A * 2/1990 Shieh ..... 81/177.8
4,991,470 A * 2/1991 Singleton ..... 81/177.7
5,860,337 A * 1/1999 Janssen ..... 81/63
6,000,302 A * 12/1999 Chiang ..... 81/177.8
6,295,898 B1 * 10/2001 Hsieh ..... 81/177.8
6,311,583 B1 * 11/2001 Izumisawa ..... 81/177.8

* cited by examiner

*Primary Examiner*—Kien Nguyen
(74) *Attorney, Agent, or Firm*—Schwartz Law Firm P.C.

(57) ABSTRACT

An adjustable closed-end wrench is adapted for rotating a threaded fastener. The wrench has a handle and a wheel housing located at a free end of the handle. An engagement wheel is arranged within the wheel housing, and has an inner periphery and an outer periphery. The inner periphery defines a fastener-receiving opening adapted for receiving the threaded fastener. The engagement wheel is mounted for selective one-way rotational movement relative to the wheel housing such that the fastener is rotatable in a clockwise or counterclockwise direction.

18 Claims, 7 Drawing Sheets

ADJUSTABLE CLOSED-END WRENCH

TECHNICAL FIELD AND BACKGROUND OF THE INVENTION

This invention relates to an adjustable closed-end wrench. The invention is applicable for automatically rotating a threaded fastener, such as a nut or bolt head, with no manual turning. The invention is usable in tight spaces, and is adjustable for convenient orientation relative to the fastener.

SUMMARY OF INVENTION

Therefore, it is an object of the invention to provide an adjustable closed-end wrench which automatically rotates a threaded fastener with no manual turning.

It is another object of the invention to provide an adjustable closed-end wrench which is especially applicable for use in tight spaces.

It is another object of the invention to provide an adjustable closed-end wrench which has a pivotable head to conveniently orient the wrench relative to the fastener.

It is another object of the invention to provide an adjustable closed-end wrench which is formed in multiple detachable and exchangeable sections.

It is another object of the invention to provide an adjustable closed-end wrench which utilizes an exchangeable head provided in a variety of SAE and metric sizes.

It is another object of the invention to provide an adjustable closed-end wrench which generates substantial torque on the fastener using an air motor and planetary gear train.

It is another object of the invention to provide an adjustable closed-end wrench which has a gear reduction ratio of at least 68:1.

These and other objects of the present invention are achieved in the preferred embodiments disclosed below by providing an adjustable closed-end wrench adapted for rotating a threaded fastener. The wrench has a handle and a wheel housing located at a free end of the handle. An engagement wheel is arranged within the wheel housing, and has an inner periphery and an outer periphery. The inner periphery defines a fastener-receiving opening adapted for receiving the threaded fastener. The engagement wheel is mounted for selective one-way rotational movement relative to the wheel housing such that the fastener is rotatable in a clockwise or counterclockwise direction. Means are provided for pivoting the wheel housing relative to the handle.

According to another preferred embodiment of the invention, the outer periphery of the engagement wheel includes a plurality of circumferentially-spaced gear teeth.

According to another preferred embodiment of the invention, a wheel-actuating gear assembly operatively engages the gear teeth of the engagement wheel to actuate the wheel and thereby rotate the fastener.

According to another preferred embodiment of the invention, the gear assembly includes cooperating first and second helical gears arranged in tandem on parallel gear shafts, and operatively connected to a vertical drive shaft.

According to another preferred embodiment of the invention, the gear assembly further includes a first bevel gear fixed to one of the first and second helical gears, and a second bevel gear operatively engaging the first bevel gear. The second bevel gear is fixed to the vertical drive shaft. The drive shaft cooperates with a motor to actuate the first and second bevel gears and the first and second helical gears of the gear assembly, thereby actuating the engagement wheel to rotate the fastener.

Preferably, the motor is an air motor operatively connected to a free end of the vertical drive shaft.

According to another preferred embodiment of the invention, a hand controller is attached to the handle and adapted for activating the air motor.

In another embodiment, the invention is a closed-end wrench adapted for rotating a threaded fastener. The wrench includes a handle and a wheel housing located at a free end of the handle. An engagement wheel is arranged within the wheel housing and has an inner periphery and an outer periphery. The inner periphery defines a fastener-receiving opening adapted for receiving the threaded fastener. The outer periphery has a plurality of circumferentially-spaced gear teeth. A wheel-actuating gear assembly operatively engages the gear teeth of the engagement wheel to actuate the wheel and thereby rotate the fastener. The gear assembly includes first and second cooperating helical gears arranged in tandem on parallel gear shafts, and operatively connected to a vertical drive shaft.

According to another preferred embodiment of the invention, the wheel housing includes first and second spaced apart and downwardly extending ears adapted for mounting the wheel housing to the handle, such that the engagement wheel operatively engages the gear assembly.

According to another preferred embodiment of the invention, means are provided for detachably connecting the wheel housing to the handle.

According to another preferred embodiment of the invention, an air motor is connected to a free end of the vertical drive shaft for actuating the drive shaft.

According to another preferred embodiment of the invention, a hand controller is attached to the handle and is adapted for activating the air motor.

In yet another embodiment, the invention is an adjustable closed-end wrench adapted for rotating a threaded fastener. The wrench includes a handle and a wheel housing located at a free end of the handle. An engagement wheel is arranged within the wheel housing and has an inner periphery and an outer periphery. The inner periphery defines a fastener-receiving opening adapted for receiving the threaded fastener. The outer periphery includes a plurality of circumferentially-spaced gear teeth. A wheel-actuating gear assembly operatively engages the gear teeth of the engagement wheel to actuate the wheel and thereby rotate the fastener. Means are provided for pivoting the wheel housing relative to the handle.

According to another preferred embodiment of the invention, the gear assembly includes first and second cooperating gears arranged in tandem on parallel gear shafts, and operatively connected to a vertical drive shaft.

Preferably, the first and second cooperating gears are respective helical gears.

According to another preferred embodiment of the invention, an air motor is connected to a free end of said vertical drive shaft for actuating said drive shaft.

According to another preferred embodiment of the invention, a hand controller is adapted for activating the air motor.

According to another preferred embodiment of the invention, the wheel housing has first and second spaced apart and downwardly extending ears adapted for mounting said wheel housing to the handle, such that the gear teeth of the engagement wheel operatively engage the wheel-actuating gear assembly.

According to another preferred embodiment of the invention, the means for pivoting the wheel housing includes a pivot shaft extending through one of the first and second helical gears. The pivot shaft has opposing first and second ends received within respective bearings formed in the downwardly extending ears of the wheel housing.

According to another preferred embodiment of the invention, means are provided for detachably connecting the wheel housing to the handle.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
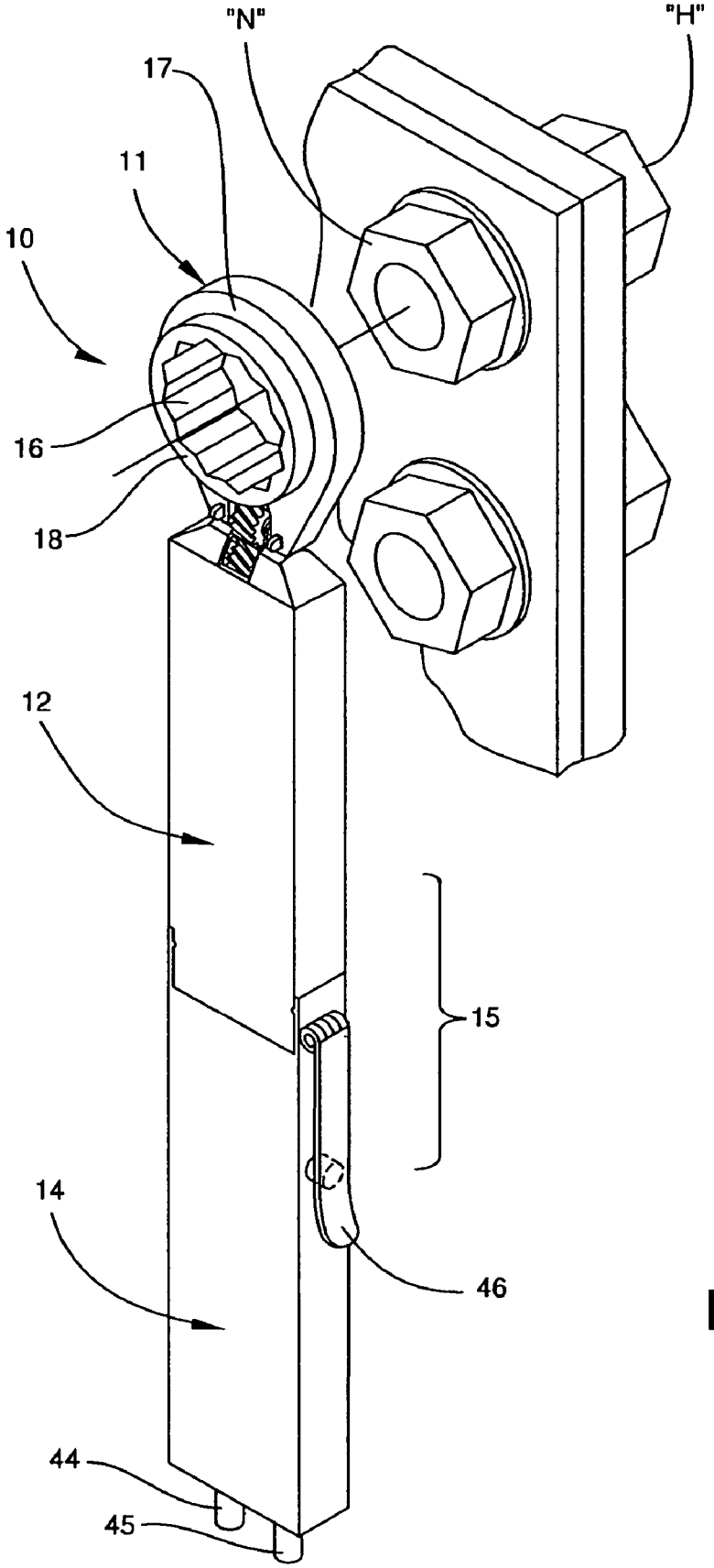
FIG. 1 is an environmental perspective view of an adjustable wrench according to one preferred embodiment of the invention.

Referring now specifically to the drawings, an adjustable closed-end wrench according to the present invention is illustrated in FIG. 1, and shown generally at reference numeral 10. The wrench 10 is applicable for automatically rotating a threaded fastener, such as a nut "N" or bolt head "H". Preferably, the wrench 10 is formed in detachable and exchangeable sections including a pivotable head 11, a body 12, and motor housing 14. The body 12 and motor housing 14 create an elongated handle 15 for being gripped by the user. The pivotable head 11 defines a fastener-receiving opening 16, and is available in multiple SAE and metric sizes. The body 12 may also be formed in various lengths and is conveniently snap-attached to the motor housing 14 to readily adjust the overall length of the handle 15.

Figure 2:
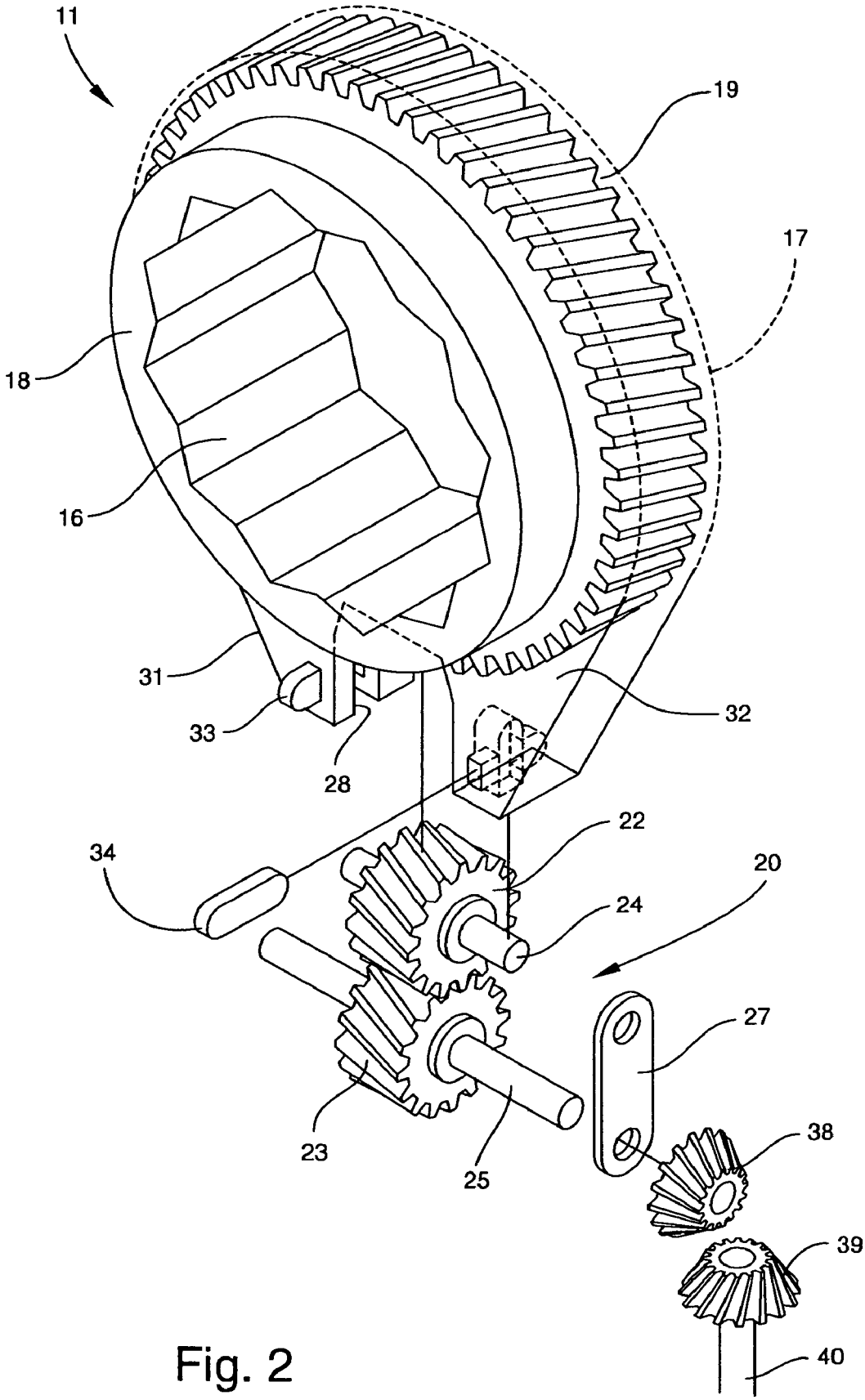
FIG. 2 is an enlarged, fragmentary, perspective view of the adjustable wrench with elements of the head and gear assembly exploded away.
Figure 3:
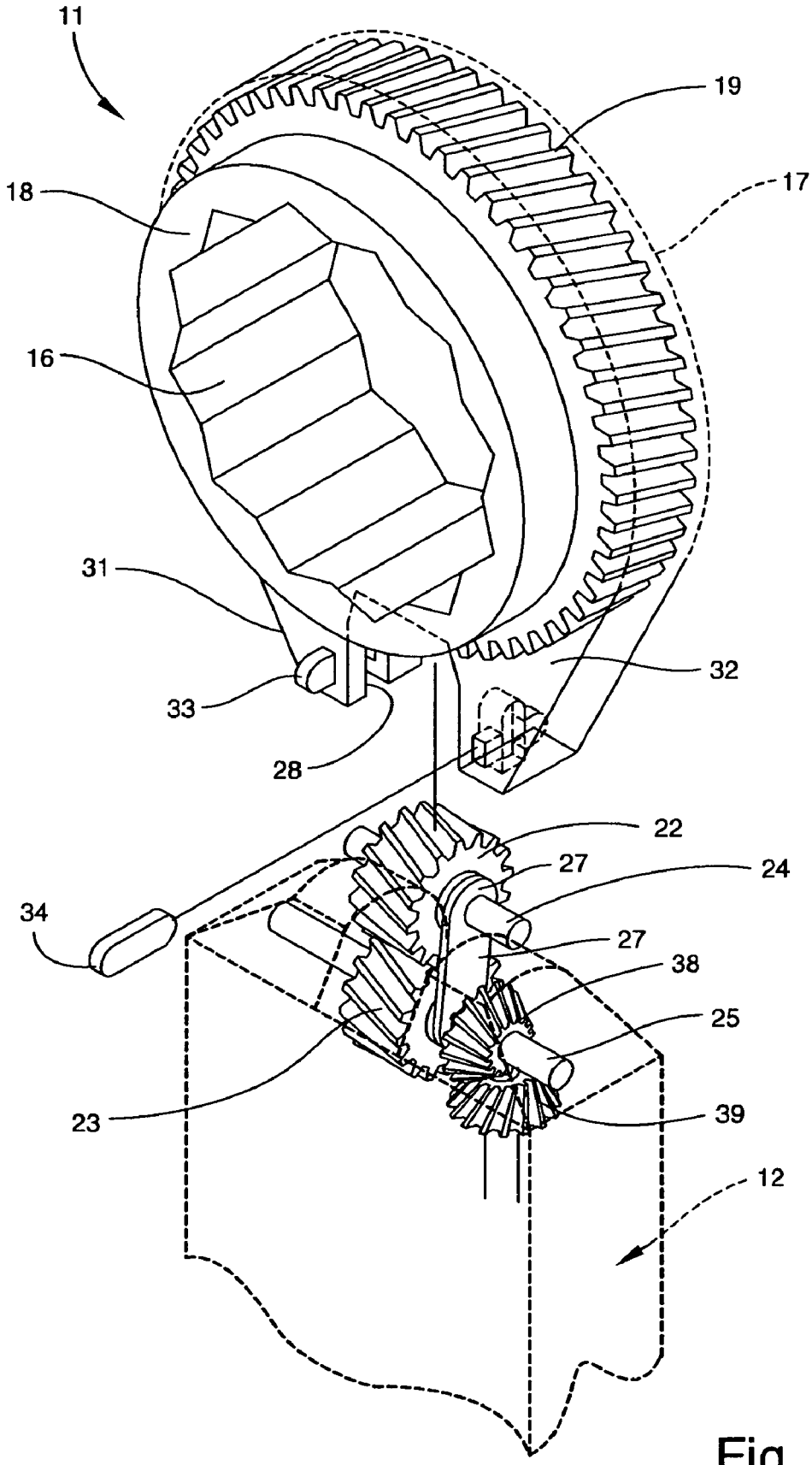
FIG. 3 is an enlarged, fragmentary, perspective view of the adjustable wrench with the head removed, and showing operative engagement of the helical gears and bevel gears.

As shown in FIGS. 1, 2, and 3, the pivotable head 11 of the wrench 10 is located at a free end of the handle 15 and includes a wheel housing 17 designed to receive and contain a rotatable engagement wheel 18. The engagement wheel 18 has an inner periphery and an outer periphery. The fastener-receiving opening 16 is formed at the inner periphery of the wheel 18, and is shaped to closely engage the points of the fastener. The outer periphery includes a series of circumferentially-spaced gear teeth 19. The gear teeth 19 are designed to operatively engage a wheel-actuating gear assembly 20. The gear assembly 20 cooperates with an air motor 21 located in the motor housing 14 to effect selective one-way rotational movement of the engagement wheel 18 relative to the wheel housing 17. When applied to the fastener, actuation of the engagement wheel 18 causes the fastener to rotate in either a clockwise or counterclockwise, as selected by the user.

Figure 4:
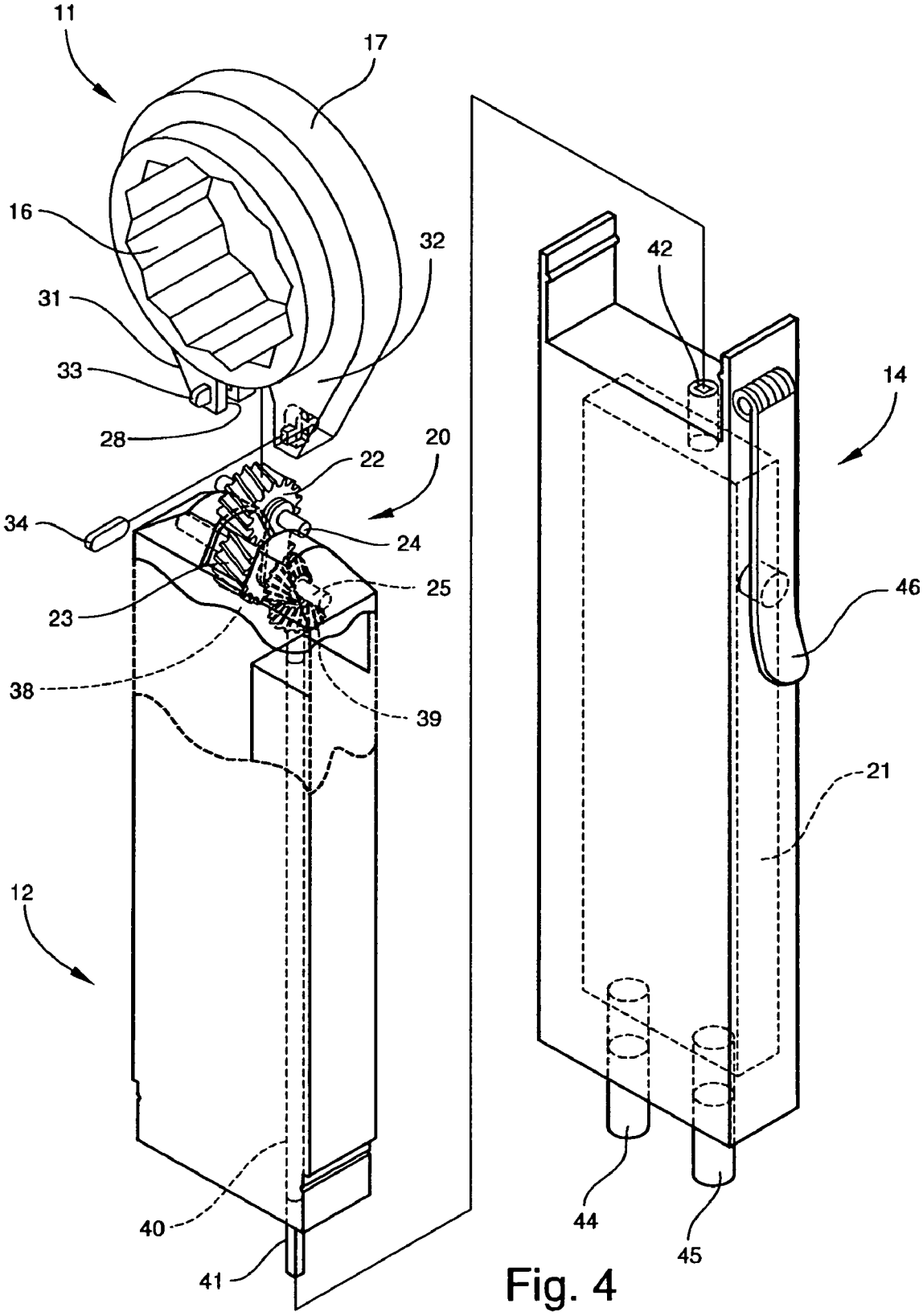
FIG. 4 is a perspective view of the adjustable wrench with all three sections detached, and showing a portions of the body and motor housing in phantom.
Figure 5:
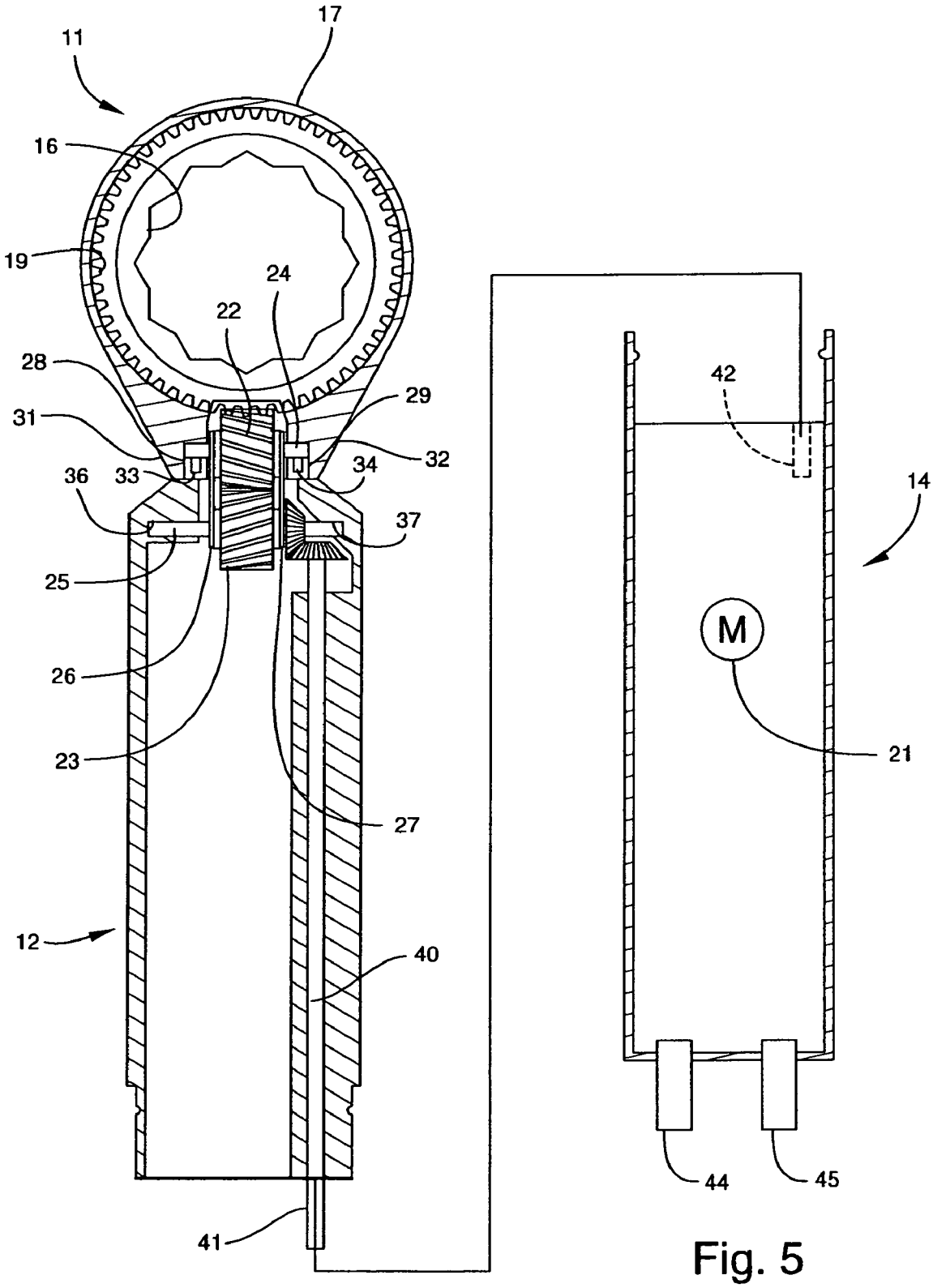
FIG. 5 is cross-sectional view of the adjustable wrench with the head attached to the body, and the body detached from the motor housing.

The gear assembly 20 is illustrated in FIGS. 2–5. The gear assembly 20 includes cooperating first and second helical gears 22 and 23 arranged in tandem on spaced-apart and parallel gear shafts 24 and 25. The gears 22, 23 are held together in meshing relation by rigid connectors 26 and 27 carried on each of the gear shafts 24, 25. Free ends of the first gear shaft 24 are received in respective slot bearings 28 and 29 formed in spaced-apart ears 31 and 32 of the wheel housing 17. With the wheel housing 17 mounted on the first gear shaft 24, the teeth 19 of the engagement wheel 18 operatively mesh with the helical gear 22, as best shown in FIG. 5. Removable retainer pins 33 and 34 extend through the bearings 28, 29 in the ears 31, 32 below free ends of the gear shaft 24 and cooperate to hold the head 11 of the wrench 10 on the end of the handle 15. The head 11 is readily and conveniently detached by removing the retainer pins 33, 34 and separating the wheel housing 17 from the gear shaft 24.

The gear shaft 25 of the second helical gear 23 is mounted in bearings 36 and 37 formed in the body 12 of the wrench 10. A bevel gear 38 is fixed to the second gear shaft 25 outside of the gear connector 27 and mates with a complementary bevel 39 gear fixed to a free end of the drive shaft 40, as best shown in FIGS. 3, 4, and 5. The drive shaft 40 extends through the body 12 of the wrench 10 and defines a four-sided free end 41 extending outwardly from the body 12 and adapted for being inserted into a complementary square shaped socket 42 formed in the motor housing 14. The socket 42 is fixed to a rotatable motor shaft (not shown) which is connected to the chuck of a dual planetary gear train located in the motor housing 14 and driven by the air motor 21. The gear train includes an assembly of meshed gears comprising a central gear, a coaxial internal or ring gear, and one or more intermediate pinions supported on a revolving carrier. Preferably, the gear system has a minimum 68:1 reduction ratio. With this reduction ratio, the chuck provides a great deal of torque actuating the motor shaft and vertical drive shaft 40. The drive shaft 40 turns the bevel gears 38, 39 which turn the helical gears 22, 23 which ultimately turn the engagement wheel 18. The gear assembly 20 is operable for rotating the engagement wheel 18 in either a clockwise or counterclockwise direction. The motor housing 14 further includes an air inlet 44 and outlet 45, and a supply line (not shown). Preferably, a convenient hand paddle 46 is attached to the motor housing 14 for activating the air motor 21.

Figure 6:
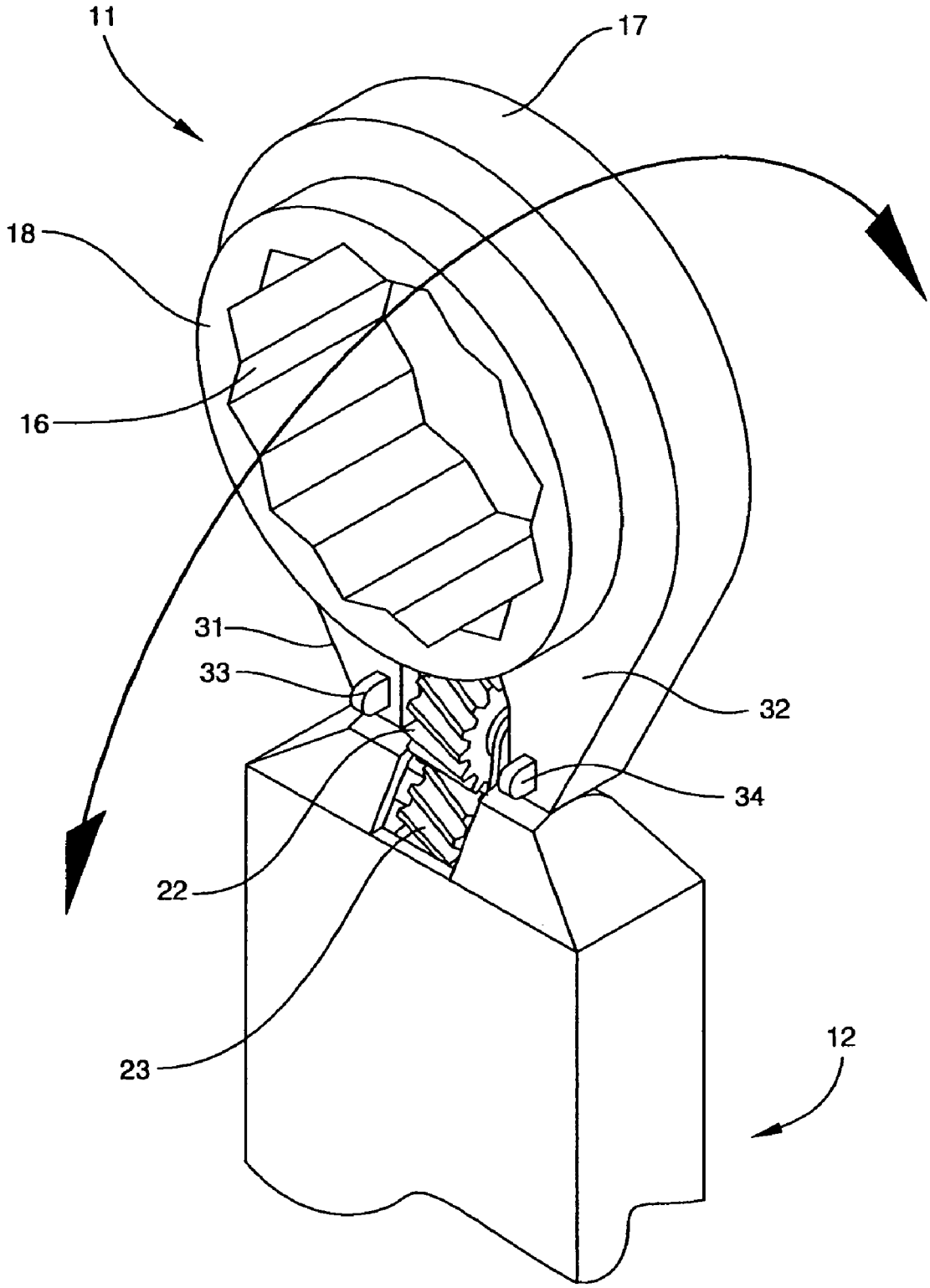
FIG. 6 is an enlarged, fragmentary, perspective view of the adjustable wrench illustrating the pivoting movement of the head relative to the handle.
Figure 7:
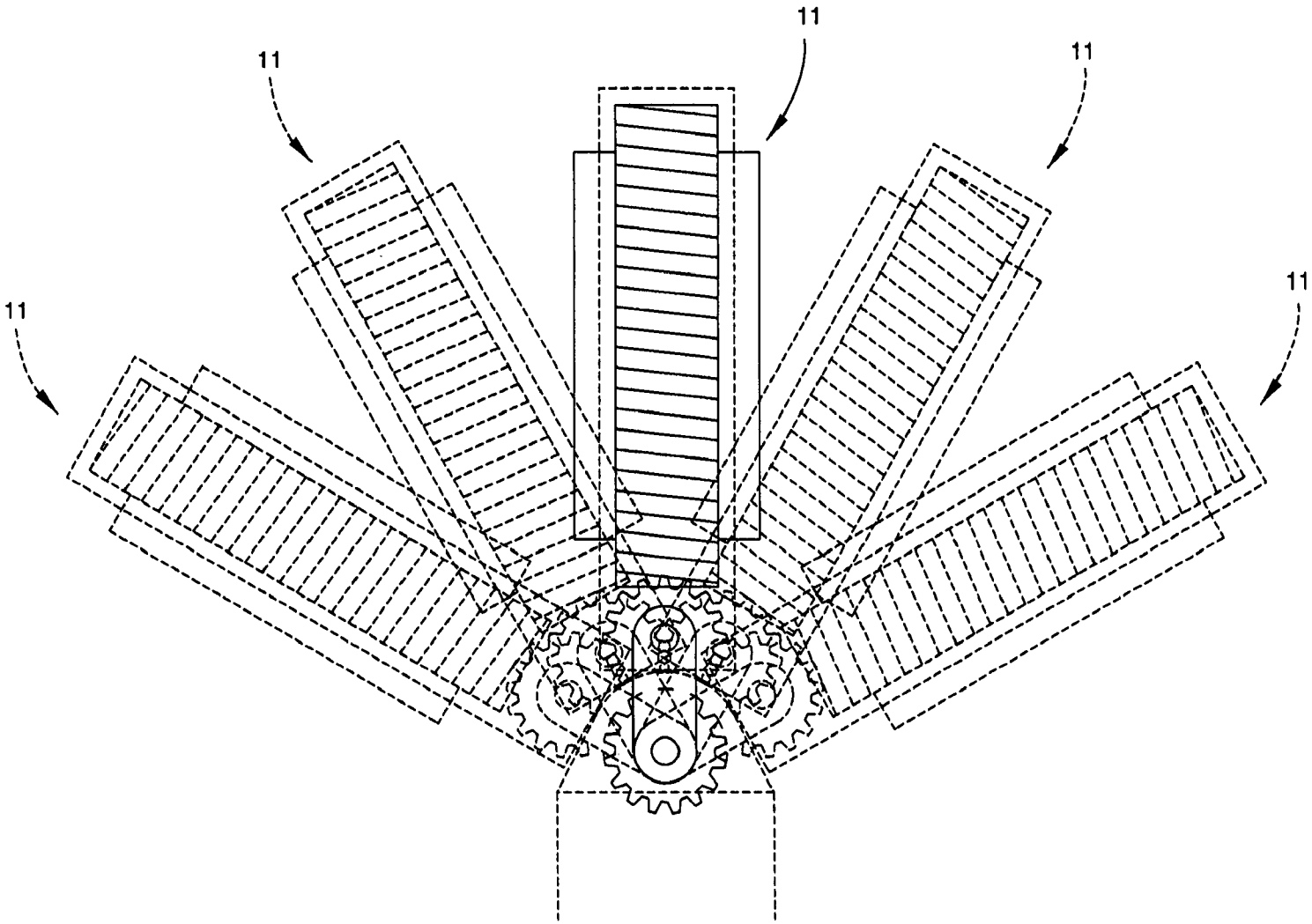
FIG. 7 is a side elevation demonstrating the preferred range of motion of the pivotable head.

Referring to FIGS. 6 and 7, the head 11 of the wrench 10 is pivotable about an axis defined by the second gear shaft 25. The first helical gear 22 rolls over the second helical gear 23, as shown in FIG. 7, with sufficient friction to set the desired position of the head 11 relative to the handle 15 prior to activating the air motor 21 and gear assembly 20. The head 11 has a preferred range of motion between 90 and 120 degrees.

An adjustable closed-end wrench is described above. Various details of the invention may be changed without departing from its scope. Furthermore, the foregoing description of the preferred embodiment of the invention and best mode for practicing the invention are provided for the purpose of illustration only and not for the purpose of limitation—the invention being defined by the claims.

I claim:

1. An adjustable closed-end wrench adapted for rotating a threaded fastener, said wrench comprising:

(a) a handle;

(b) a wheel housing located at a free end of said handle;

(c) an engagement wheel arranged within said wheel housing and having an inner periphery and an outer periphery, the outer periphery comprising a plurality of circumferentially-spaced gear teeth, and the inner periphery defining a fastener-receiving opening adapted for receiving the threaded fastener, and said engagement wheel being mounted for selective one-way rotational movement relative to said wheel housing such that the fastener is rotatable in a clockwise or counterclockwise direction;

(d) a wheel-actuating gear assembly operatively engaging the gear teeth of said engagement wheel to actuate said wheel and thereby rotate the fastener; and (e) means for pivoting said wheel housing relative to said handle.

2. An adjustable closed-end wrench according to claim 1, wherein said gear assembly comprises cooperating first and second helical gears arranged in tandem on parallel gear shafts, and operatively connected to a vertical drive shaft.

3. An adjustable closed-end wrench according to claim 2, wherein said gear assembly further comprises a first bevel gear fixed to one of said first and second helical gears, and a second bevel gear operatively engaging said first bevel gear and fixed to said vertical drive shaft, said drive shaft cooperating with a motor to actuate said first and second bevel gears and said first and second helical gears of said gear assembly, thereby actuating said engagement wheel to rotate the fastener.

4. An adjustable closed-end wrench according to claim 3, wherein said motor comprises an air motor operatively connected to a free end of said vertical drive shaft.

5. An adjustable closed-end wrench according to claim 4, and comprising a hand controller attached to said handle and adapted for activating said air motor.

6. An adjustable closed-end wrench adapted for rotating a threaded fastener, said wrench comprising:

(a) a handle;

(b) a wheel housing located at a free end of said handle;

(c) an engagement wheel arranged within said wheel housing and having an inner periphery and an outer periphery, the inner periphery defining a fastener-receiving opening adapted for receiving the threaded fastener, and said outer periphery comprising a plurality of circumferentially-spaced gear teeth;

(d) a wheel-actuating gear assembly operatively engaging the gear teeth of said engagement wheel to actuate said wheel and thereby rotate the fastener, said gear assembly comprising first and second cooperating helical gears arranged in tandem on parallel gear shafts, and operatively connected to a vertical drive shaft.

7. An adjustable closed-end wrench according to claim 6, wherein said wheel housing comprises first and second spaced apart and downwardly extending ears adapted for mounting said wheel housing to said handle, such that said engagement wheel operatively engages said gear assembly.

8. An adjustable closed-end wrench according to claim 6, and comprising means for detachably connecting said wheel housing to said handle.

9. An adjustable closed-end wrench according to claim 6, and comprising an air motor connected to a free end of said vertical drive shaft for actuating said drive shaft.

10. An adjustable closed-end wrench according to claim 9, and comprising a hand controller attached to said handle and adapted for activating said air motor.

11. An adjustable closed-end wrench adapted for rotating a threaded fastener, said wrench comprising:

(a) a handle;

(b) a wheel housing located at a free end of said handle;

(c) an engagement wheel arranged within said wheel housing and having an inner periphery and an outer periphery, the inner periphery defining a fastener-receiving opening adapted for receiving the threaded fastener, and said outer periphery comprising a plurality of circumferentially-spaced gear teeth;

(d) a wheel-actuating gear assembly operatively engaging the gear teeth of said engagement wheel to actuate said wheel and thereby rotate the fastener, and (e) means for pivoting said wheel housing relative to said handle.

12. An adjustable closed-end wrench according to claim 11, wherein said gear assembly comprises first and second cooperating gears arranged in tandem on parallel gear shafts, and operatively connected to a vertical drive shaft.

13. An adjustable closed-end wrench according to claim 12, wherein said first and second cooperating gears comprise respective helical gears.

14. An adjustable closed-end wrench according to claim 13, and comprising an air motor connected to a free end of said vertical drive shaft for actuating said drive shaft.

15. An adjustable closed-end wrench according to claim 14, and comprising a hand controller adapted for activating said air motor.

16. An adjustable closed-end wrench according to claim 13, wherein said wheel housing comprises first and second spaced apart and downwardly extending ears adapted for mounting said wheel housing to said handle, such that the gear teeth of said engagement wheel operatively engage said wheel-actuating gear assembly.

17. An adjustable closed-end wrench according to claim 16, wherein said means for pivoting said wheel housing comprises a pivot shaft extending through one of said first and second helical gears, and having opposing first and second ends received within respective bearings formed in the downwardly extending ears of said wheel housing.

18. An adjustable closed-end wrench according to claim 11, and comprising means for detachably connecting said wheel housing to said handle.

* * * * *